US006273009B1

(12) United States Patent
Magnusson

(10) Patent No.: US 6,273,009 B1
(45) Date of Patent: Aug. 14, 2001

(54) METHOD FOR AUTOMATIZED COMBUSTION AND COMBUSTION APPARATUS

(75) Inventor: Jan Magnusson, Åmål (SE)

(73) Assignee: Swedish Bioburner System Aktiebolag (SE)

( * ) Notice: Subject to any disclaimer, the term of this patent is extended or adjusted under 35 U.S.C. 154(b) by 0 days.

(21) Appl. No.: 09/555,477

(22) PCT Filed: Oct. 13, 1998

(86) PCT No.: PCT/SE98/01836

§ 371 Date: Jun. 1, 2000

§ 102(e) Date: Jun. 1, 2000

(87) PCT Pub. No.: WO99/28678

PCT Pub. Date: Jun. 10, 1999

(30) Foreign Application Priority Data

Dec. 3, 1997 (SE) ..... 9704492

(51) Int. Cl.[7] ..... F23N 5/18; F23D 1/00; F27B 7/32; F23K 3/00

(52) U.S. Cl. ..... 110/346; 110/234; 110/185; 110/186; 110/191; 110/235; 110/246; 110/255; 110/263; 110/267; 110/327; 110/347; 110/101 R; 110/103; 110/101 C; 110/101 CF; 432/117

(58) Field of Search ..... 110/233, 234, 110/185, 186, 190, 191, 193, 235, 246, 248, 255, 263, 264, 267, 327, 346, 347, 101 R, 102, 103, 101 C, 101 CF; 432/105, 117

(56) References Cited

U.S. PATENT DOCUMENTS

| | | | | |
|---|---|---|---|---|
| 3,822,651 | * | 7/1974 | Harris et al. | 110/10 |
| 4,060,042 | * | 11/1977 | Baralbi et al. | 110/14 |
| 4,395,958 | * | 8/1983 | Caffyn et al. | 110/246 |
| 4,408,547 | | 10/1983 | Autere | 110/234 |
| 4,611,544 | * | 9/1986 | Thrap Olsen | 110/341 |
| 4,669,396 | | 6/1987 | Resh | 110/233 |
| 4,782,766 | * | 11/1988 | Lee et al. | 110/190 |
| 4,876,971 | * | 10/1989 | Oconner | 110/246 |
| 4,953,474 | * | 9/1990 | Armitage | 110/101 CD |
| 5,361,710 | * | 11/1994 | Gutmark et al. | 110/346 |
| 5,530,176 | * | 6/1996 | Brady | 588/261 |
| 5,680,822 | | 10/1997 | Hallberg | 110/261 |
| 5,727,483 | * | 3/1998 | Chen et al. | 110/246 |
| 6,105,275 | * | 8/2000 | Aulbaugh et al. | 34/424 |

FOREIGN PATENT DOCUMENTS 0 346 531 A1 6/1988 (EP) .

OTHER PUBLICATIONS

European Search Report for Application No. EP 88 30 5360, dated Feb. 8, 1989.

International Search Report for PCT/SE98/01836, dated Feb. 1, 1999.

"Burning Control Device for Incinerator", Translation of Japanese Patent Abstract of JP 60–178214 A, issued on Sep. 12, 1985.

* cited by examiner

*Primary Examiner*—Denise L. Ferensic
*Assistant Examiner*—K. B. Rinehart
(74) *Attorney, Agent, or Firm*—George T. Marcou; Kirkpatrick Stockton LLP

(57) ABSTRACT

A method for automatized combustion of solid fuel in a combustion apparatus which comprises a burner with a device, which is rotatable about the center axis of the burner for stirring the fuel in the burner which is connected to a boiler and has a feeding-in opening for fuel in the rear end of the burner outside of the boiler and an outlet opening for completely or partly combusted flue gases in the front end of the burner which opens in a combustion chamber inside the boiler which comprises a convection unit, from which a hot water conduit extends, the combustion apparatus also including a fan provided to be driven by a second motor for blowing combustion air into the burner, and a fuel charge feeder for fuel provided to be driven by a third motor.

9 Claims, 9 Drawing Sheets

METHOD FOR AUTOMATIZED COMBUSTION AND COMBUSTION APPARATUS

TECHNICAL FIELD

The invention relates to a method for automatized combustion of solid fuel in a combustion apparatus which comprises a burner with a device, which is rotatable about the centre axis of the burner for stirring the fuel in the burner which is connected to a boiler and has a feeding-in opening for fuel in the rear end of the burner outside of the boiler and an outlet opening for completely or partly combusted flue gases in the front end of the burner which opens in a combustion chamber inside the boiler which comprises a convection unit, from which a hot water conduit extends, said combustion apparatus also including a fan provided to be driven by a second motor, here called fan motor, for blowing combustion air into the burner, and a fuel charge feeder for fuel provided to be driven by a third motor, here called fuel charge feeding motor. The invention also relates to the said combustion apparatus.

BACKGROUND OF THE INVENTION

Solid fuels have a number of significant advantages before fuel oil; they are generally cheaper, they are available in large amounts, and they take part in a natural circulation and do not cause pollution load on the environment in spite of their emission of carbon dioxide, when they are based on wood or other renewable bio-products. Nevertheless, solid fuels are used to a comparatively small degree in the modern society. The main reason for this condition probably is that it is easy to automatize combustion of fuel oil but comparatively difficult to automatize combustion of solid fuel, and it is particularly difficult to automatize solid fuel combustion in order to provide an efficient combustion at all heating effect levels without emission of products with the fuel gases which are harmful to the environment.

BRIEF DISCLOSURE OF THE INVENTION

It is the purpose of the invention to solve the said problems. More particularly, the invention aims at providing a method and a combustion apparatus of the kind mentioned in the preamble, wherein the apparatus shall satisfy the following objectives:

- The combustion device shall be able to operate essentially automatically, i.e. with only small manual operations. These operations normally shall be limited to the very ignition- and starting up operation, which according to official directions for solid fuel combustion plants has to be performed under manual supervision. Also the feeding out of ash shall preferably be able to be made automatically.
- The starting up shall be easy to perform.
- The combustion apparatus shall have a high efficiency, i.e. allow a high degree of utilization of the energy content of the fuel for transformation to heat energy which can be utilized in the convection unit of the boiler.
- The combustion apparatus shall provide desired boiler water temperature with desired, preferably adjustable accuracy.
- The combustion apparatus shall be able to be used for different effect needs and shall have a wide range of control with reference to generated effect.
- The combustion apparatus shall be highly fireproof and have a high safety against breakdowns and other disturbances or accidents.

- The combustion apparatus shall be able to be applied to a great number of different boilers.
- The apparatus shall be easy to trim, which i.a. implies that the method of operation of the apparatus shall be such that it readily, through the setting of various parameters in a control program, can be adapted to those conditions which apply in every single case, such as the effect need, the character of the fuel, etc.
- The flue gases which are emitted from the combustion apparatus shall at all effect levels only contain products which will lie well below permitted emission values.
- The combustion apparatus shall be easy to trim in the complete intended effect range of the combustion apparatus, which also contributes to the low emission values.
- The combustion apparatus shall have a high reliability of operation and have a long working life, it shall have comparatively small dimensions and be able to be made of non-complicated and non-expensive components.

These objectives and advantages of the invention can be achieved therein that the invention is characterized by what is stated in the appending patent claims. Further characteristics and aspects of the inventions will be apparent from the following description of a preferred embodiment.

BRIEF DESCRIPTION OF DRAWINGS

In the following description of a preferred embodiment of the invention, reference will be made to the accompanying drawings, in which.

DESCRIPTION OF PREFERRED EMBODIMENTS

Main Units of the Combustion Apparatus

Figure 1:
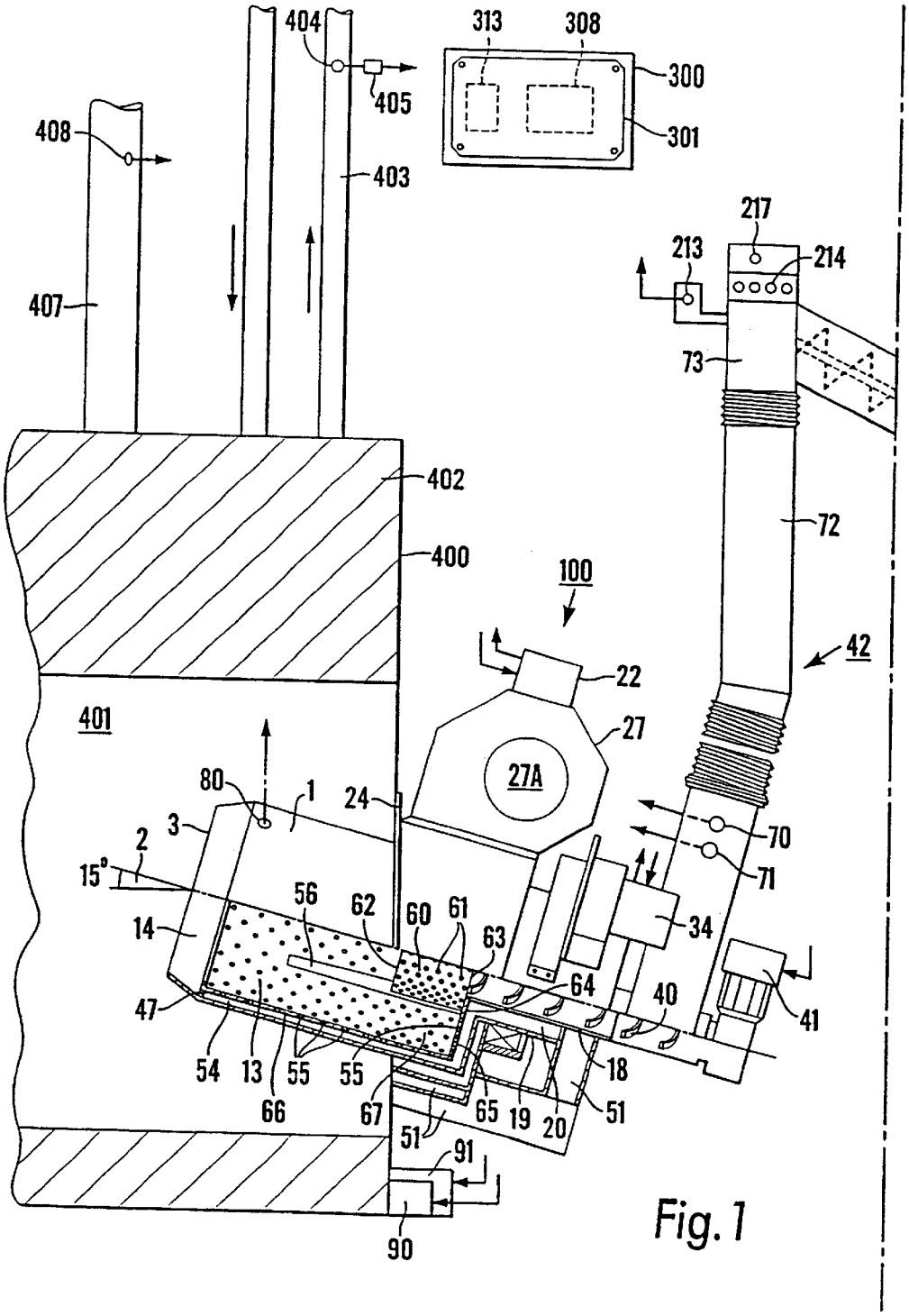
FIG. 1 illustrates, partly schematically the automatized combustion apparatus
Figure 1A:
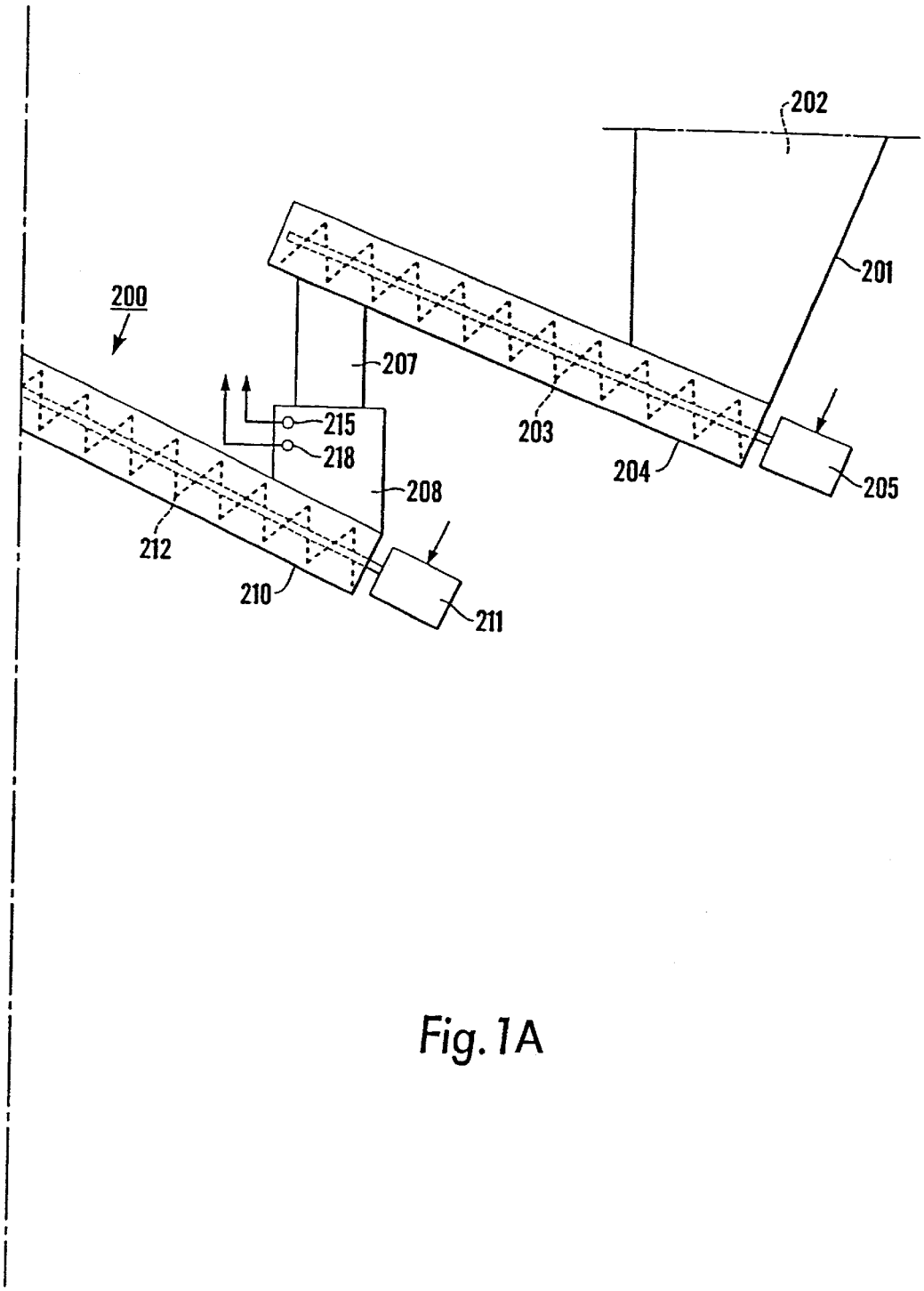
FIG. 1A illustrates, the automated combustion apparatus continued from FIG. 1.
Figure 2:
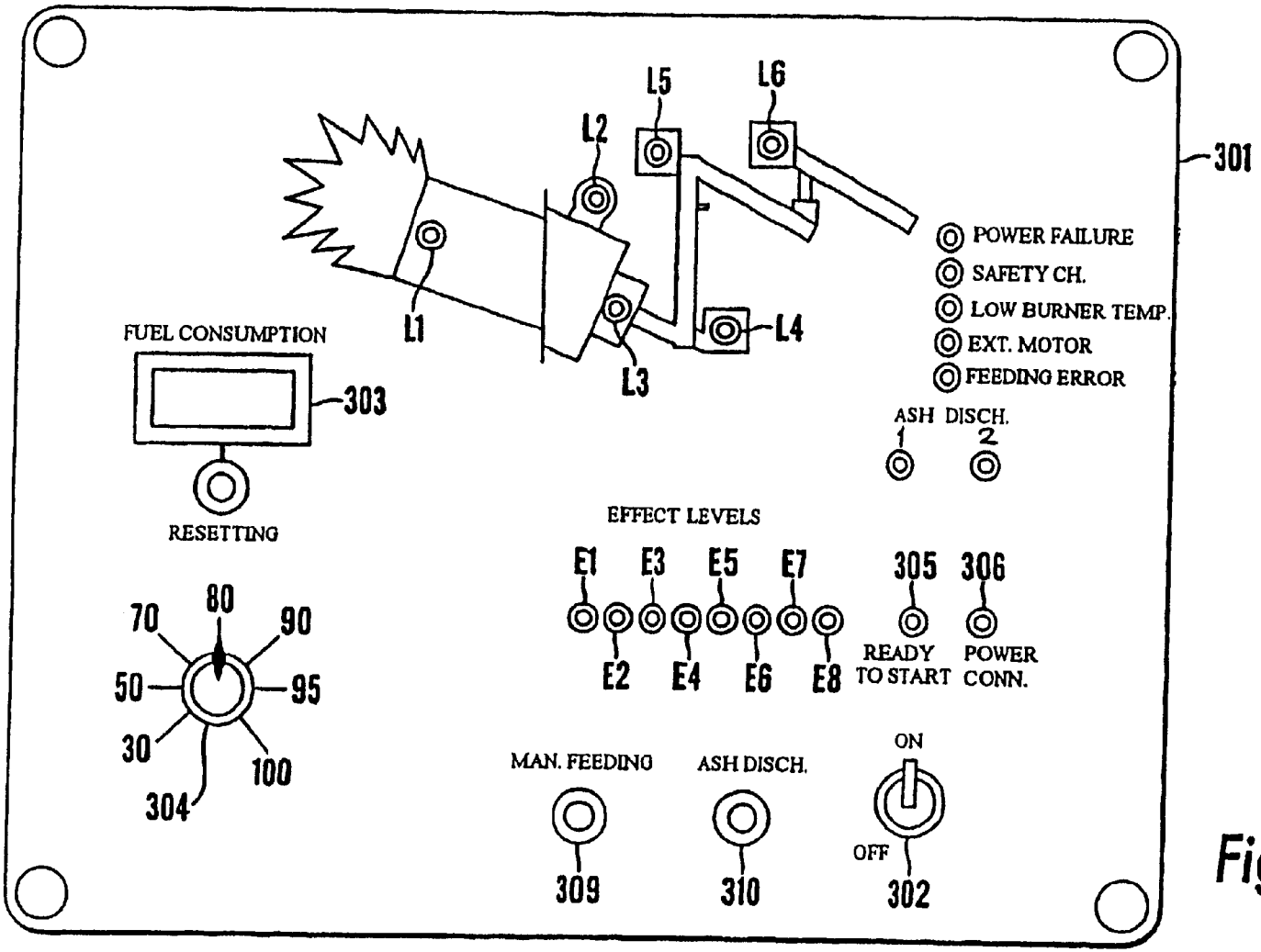
FIG. 2 shows the control panel of a control unit.

The main units of the combustion apparatus consist of a burner assembly 100, a fuel charge feeder assembly 200, and a control unit 300. The burner assembly 100 is connected to a schematically shown boiler 400, which may be of a conventional kind.

Description of the Burner Assembly 100

In the burner assembly 100 there is included a solid fuel burner or reactor which has the general shape of a vessel, more particularly the shape of a drum. According to the embodiment, the reactor drum 1 is circular-cylindrical and is rotatable about a slightly inclined axis of rotation. It has an outer flange 24 for mounting the whole burner assembly 100 on a boiler door of the schematically shown boiler 400, such that an opening 3 for the combustion gases in the front end of the burner will mount in the combustion chamber 401 of the boiler. The interior of the burner forms a main or primary combustion chamber and an after- or secondary combustion chamber 14.

Other components of the burner assembly 100 consist of at least a fan 27 for combustion air, at least a fan motor 22, in this text also called second motor, for rotation of the fan 27 (as an alternative, two or more fans with accompanying motors can be provided, including one fan with its motor for blowing primary combustion air into the main or primary combustion chamber and an other fan with its motor for blowing secondary combustion air into the after- or secondary combustion chamber 14), a coreless feeding-in screw 40 in a fuel feeding-in tube 18 for a particle shaped solid fuel, a feeding-in motor 41, in this text also called fourth motor, for rotation of the feeding-in screw 40, a stirring motor 34, in this text also called first motor, for rotation of the reactor drum 1 about the inclined axis 2 of rotation, and the lower part of a down-pipe 42 for the fuel. The sloping angle of the reactor drum 1 to the horizontal plane, with the reactor drum's front opening 3 for combustion gas directed obliquely upwards, is 15°.

The rear end wall of the reactor drum 1 is double-walled, as is the main part of its cylindrical part. The space between the inner 65, 66 and the outer walls is denoted 54. The inner walls 65, 66 are provided with holes 55 in the cylindrical part as well as in the rear end part for the introduction of combustion air into the main burner chamber 13. The holes in the inner cylindrical wall 66 are more dense in the rear part of the primary combustion chamber 13 and somewhat more sparsely distributed in the front part. Furthermore, the intermediate space 54 is divided into channels through longitudinal, radially directed, lamella-shaped partition walls in the cylindrical part of the reactor drum, and in the rear end of the drum there are partition walls which form between themselves circular sector-shaped channels for combustion air. The partition walls in the rear part are connected to those in the cylindrical part so that each circular sector-shaped channel in the end wall communicates with a longitudinal channel in the cylindrical part but only with one and not with any more such longitudinal channel. The air streams through these channels can be regulated by means of valve members which are not shown, causing the combustion air in the first place or substantially to be guided into the lower, rear parts of the combustion chamber, which are located beneath an interior, smaller drum 60 in the rear part of the reactor drum 1, as will be described more in detail in the following. The combustion air thus in the first place or substantially is introduced into those parts of the main combustion chamber 13 where the fuel is collected during the combustion. As an alternative or as a complement two or more fans can be provided, which transport air to the primary combustion- and to the secondary combustion chamber, respectively, as has been mentioned above. This can be particularly advantageous for burners for high effects, i.e. in the order of size of 1 MW or more.

The rear, inner wall 65 of the drum 1 and particularly the rear part of the cylindrical inner wall 65 of the drum 1 constitutes the fire grate of the burner. The drum with its inner walls is a rotatable device for stirring the fuel in the burner. In order further to secure an efficient stirring of the fuel, activators 56 are provided on the inside of the reactor drum 1, said activators extending all the way back to the end wall 65 and follow the rotation of the reactor drum 1.

The inner, small drum 60 is cylindrical and is perforated. According to the embodiment, the drum consists of a sheet metal drum with holes in the jacket, but a net drum is also conceivable. The holes in the jacket are designated 61. These are so small—the diameter or greatest extension amounts to 10 mm maximum, preferably 8 mm maximum—that the fuel particles can not pass through them to any considerable degree. In front, the drum 60 is completely open. This opening is designated 62. The drum 60 is co-axial with the reactor drum 1 and surrounds a central feed opening 63 which forms the mouth or orifice of the feeding-in tube 18 for the fuel, which is fed in by the feeding-in screw 40. The diameter of the drum 60 is somewhat larger than the opening 63. In the annular space 64 between the feeding-in opening 63 and the drum 60, the rear end wall 65 of the reactor drum 1 has no inlet openings for combustion air. The drum 60 is welded to the rear end wall of the reactor drum 1.

The fuel feeding-in tube 18 is surrounded by a concentric, tubular driving shaft 19, which also serves as an air injection pipe. In the cylindrical space 20 between the feeding-in tube 18 and the driving shaft 19 there are, in same mode as in the cylindrical space 54 between the cylindrical outer and inner walls of the drum, longitudinal, radially directed partition walls extending between the tube 18 and the shaft 19, so that longitudinal channels are defined between said walls in the same way as the channels between the walls in the cylindrical part of the-drum 1. Each partition wall in the space 20 thus is connected with one and only one partition wall in the space 54. Thus there is formed a system of channels which are separated from each other—according to the embodiment eight such channels—which extend from the rear end of the tube 19 all the way to the front end of the main combustion chamber 13, where the channels are closed by an annular end wall 47.

In the rear part of the drum 1, approximately corresponding to the half length of the drum, the drum is surrounded by a double walled casing which is obliquely cut off at an angle which corresponds to the angle of inclination of the drum and is terminated by said flange 24 for mounting the burner assembly on a boiler door or boiler wall by means of screws. That part of the device which in FIG. 1 is to the left of the flange 24 thus extends into the combustion chamber 401 in the boiler 400, while the parts to the right of the flange 24 are located outside of the boiler.

The combustion air is drawn in by the fan 27 through an air intake 27A and is pushed via the air conduits 51 and via the not shown valve system (a throttle) into the air injection pipe/shaft 19, and from the interior 20 thereof into the channels in the intermediate space 54 and finally through the holes 55 into the combustion chamber 13.

For the driving of the fan 27, the drum 1, and the feeding-in screw 40 by the fan motor 22, the stirring motor 34, and the feeding-in motor 41, respectively, there are provided transmissions (not shown), which however, in a conventional mode may consist of axles, chains, belts, or other conventional elements. The feeding-in screw 40 is provided to be rotated by the feeding-in motor in a direction opposite to that of the drum 1.

The fuel that falls down in the down-pipe 42 is immediately proceeded further on by the feeding-in screw 40. If, because of any misfunction, the feeding-in screw 40 would not transport the fuel fast enough to keep pace with the fuel that it is falling down through the down-pipe 42, some amount of fuel will collect in the lower part of the down-pipe 42. This is not desirable, above all from a safety point of view. Therefore, in order to limit such possibly collected amount of fuel, a level guard 70 is located in the down-pipe 42 to emit a signal to the control unit 300, if the amount of fuel in the lower part of the down-pipe would rise up to the level guard 70, so that further transportation of fuel to the down-pipe 42 is stopped. According to the embodiment, this volume amounts only to 3 liters. In the lower part of the down-pipe 42 there is also provided a temperature guard 71, which is provided to emit a signal to the control unit 300, if the temperature would rise to a certain, set temperature, so that the burner is emergency stopped, which implies that the feeding-in of fuel and of combustion air to the burner is stopped as well as the rotation of the drum. As an additional safety measurement, a section 72 of the down-pipe consists of non-combustible plastic hose, which is melted off if the temperature in the down-pipe in said section nevertheless would exceed a certain temperature. Further, as still another safety measurement, the upper section 73 of the down-pipe is laterally displaced, so that any fuel will not fall down on the burner assembly, if the plastic section 70 would be melted off It shall be realized that the burner assembly 100 can be modified within the scope of the invention. For example, the rotating drum 1, whether it contains an inner, smaller drum 60 or not, can be positioned completely horizontally. In this case, however, the drum should be made tapered, i.e. conically tapered, from the rear wall and forwards, so that the bottom of the drum will get approximately the same level of inclination as has been shown in the described embodiments, wherein the fuel also in this case will be collected on the bottom of the rear part of the drum, where the injection of primary air is concentrated. One can further conceive that there does not exist any sharp corner between the rear end wall and the side wall which corresponds to the jacket of the drum but instead, e.g. a bevelled transition. A burner which is completely void of corners, e.g. a burner with the substantial shape of an egg or pear cut off at both ends, in which the more pointed part is directed forwards towards the outlet opening, however, is a design which is most suitable from some points of view. Also in this case the burner is double-walled with the intermediate space between the walls divided into channels, or otherwise provided with channels for combustion air from the air inlet pipe, which surrounds the central fuel feeding-in pipe, and further outwards and forwards.

Description of the Fuel Charge Feeding Assembly 200

The fuel charge feeding assembly 200 according to the embodiment is connected to a storage container 201 for particle shaped fuel 202, preferably pellets, via an external conveyer screw 203, which is rotatable in a conveyer tube 204 obliquely upwards by means of a fifth motor, here called external motor 205. In the upper end of the conveyer tube 203 the conveyed fuel falls down through a down shaft 207 to a transitory fuel storage 208.

A fuel charge feeding tube 210, which slopes upwards, has a rear inlet opening for fuel from the transitory storage 208. In the fuel charge feeding tube 210 there is a fuel charge feeding screw 212, which is rotatable with variable frequence, particularly intermittently rotatable, by means of a fuel charge feeding motor 211. The tube 210 in its upper end terminates in the upper feeding-in end of the down-pipe 42, where a smoke-detector 213 is located and provided to emit a signal to the control unit 300 in case of smoke in the down-pipe 42 in order to stop all motors in the combustion apparatus. A temperature guard 217 is located in the upper part of, or above, the down-pipe 42. If the temperature in the region of the temperature guard 217 would rise to a certain, set value, the temperature guard 217, which is not dependent on electric current, emits a command directly to a non-current-depending valve, so that water is supplied to a sprinkler 214 at top of the down-pipe 42 for water-soaking of the overheated region.

Description of the Mode of Operation of the Combustion Apparatus

Figure 3:
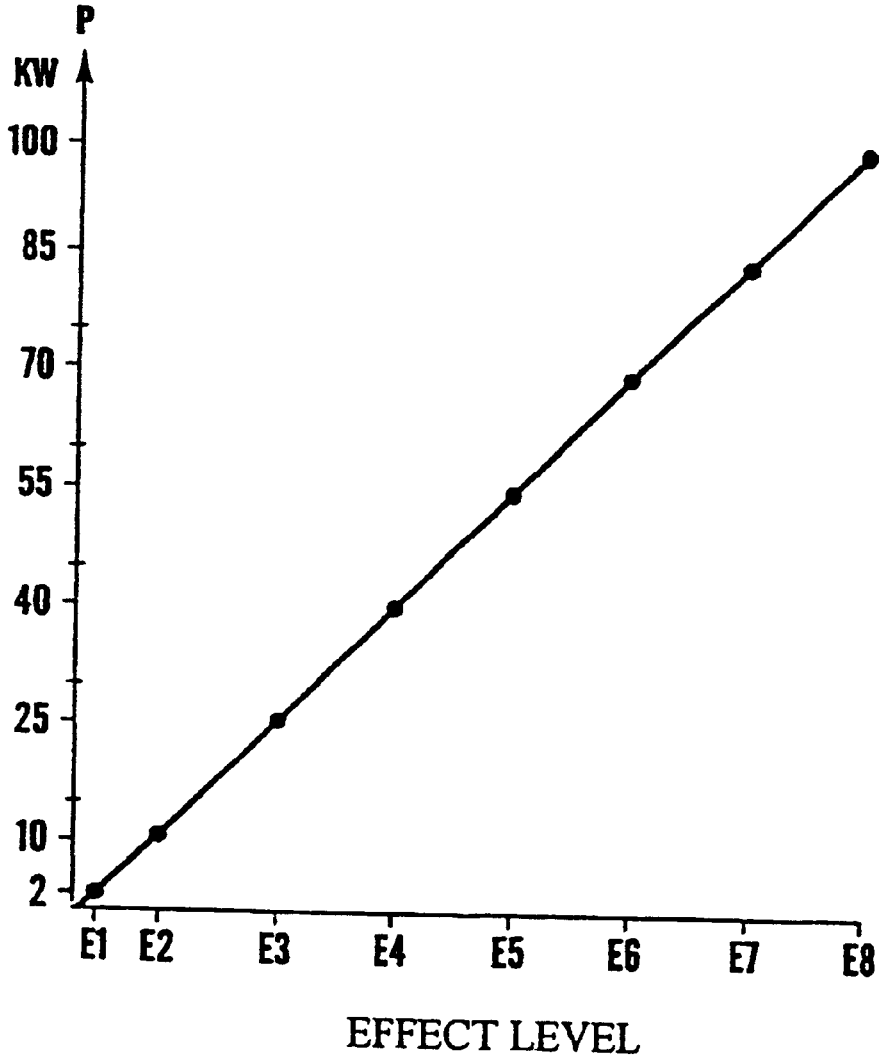
FIG. 3 is an effect level chart.

Before the control unit 300 is described, the principles for the mode of operation of the combustion apparatus will be explained. The control unit is provided to be set at a number of fixed effect levels; according to the embodiment at eight effect levels. The invention's principle of employing a number of fixed effect levels significantly facilitates the trimming of the apparatus. With "effect level" shall be understood that the burner 1 at each effect level shall generate a certain heating effect which can be utilized in the convection unit 402 of the boiler for heating the water in the boiler. In an example of application, which does not limit the principles of the invention, the maximum effect of the burner is 120 kW, which corresponds to effect level E8, FIG. 3. Effect level E1 is a keep-alive level, at which the burner generates 2 kW. At the effect levels E2, E3, E4, . . . E7 the burner 1 shall generate 10, 25, 40, 55, 70, and 85 kW, respectively, through control by the control unit 300. The temperature of the water in a hot water conduit 403 is measured by means of a resistive type thermometer 404, which emits an analogue signal with a magnitude in relation to the temperature. The measure signal is transmitted via an analogue-digital-converter 405, FIG. 5, to a main-CPU 308 (Computer Processing Unit, i.e. a microprocessor or a so called PROM) in the control unit 300. The basic principle is that the generated effect of the burner is changed to a higher effect level, e.g. from effect level E6, at which the burner generates 70 kW, to effect level E7, at which the burner generates 85 kW, if the temperature in the hot water conduit 403 would drop a certain pre-set margin below a certain set value, e.g. 80° C. In a corresponding way there is a change to a lower effect level, if the temperature in the- hot water conduit 403 would rise above the upper margin of the set value. In this way the generated effect of the burner may hover between the pre-set fixed effect levels, which, however, does not mean, as will be apparent from the following, that the mode of operation of the combustion apparatus gets a choppy character. To the contrary the change between the different effect levels take place smoothly in spite of its seemingly jumpy character, which is calculated to give a high combustion efficiency and a very low emission of undesired products in the flue gases. How the burner assembly 100 and the fuel charge feeder assembly 200 work in co-operation with each other in dependency of the control unit 300 at the different effect levels now shall be explained. First, however, shall be described how the ignition/start up of the burner is carried out.

Start Up

A small quantity of fuel is scooped into the burner/drum 1, e.g. two liters, when it is the question of a burner dimensioned for a maximum effect of 100 kW. It is presupposed that the fuel consists of pellets. In the following description this term will be used, although the invention does not exclude also other types of solid fuel from being used. Suitably, the start quantity of fuel is thrown in from the front through the opening 3, after the boiler door has been opened and the burner assembly has been swung out, which is possible to do. It is, however, also possible to feed the desired quantity through manually operated feeding of the feeding-in screw 40 via the control unit 300. The start up quantity of fuel in the burner then is set fire to, e.g. by means of a long burning match, a fire-up paper, or other fire-up matter which burning is thrown into the burner from the front. When it is stated that the pellets have caught fire the boiler door is closed and the automatic control is switched on by means of the button 302 on the control panel 301 of the control unit 300. Further the hot water temperature is set at a desired set value, e.g. 80° C., by means of the knob 304, if that is not done already. It shall also be mentioned that the accuracy can be graduated, i.e. the desired temperature can be fine-adjusted to a desired degree through pre-setting of the dissolution of the temperature measurement. In this way it is according to the example of the embodiment selected dissolutions varying between 0.2° C. and 2° C. Further, according to the example of the embodiment, the control unit is provided to cause the combustion apparatus to change effect level if the hot water temperature would exceed a certain, pre-set set value—e.g. 80° C.—with four pre-setting (dissolution-)units. If the dissolution is 2° C., the range of regulation in other words will be ±8° C., i.e. totally 16° C., but only 1.6° C. if the dissolution is as fine as 0.2° C.

Figure 4A:
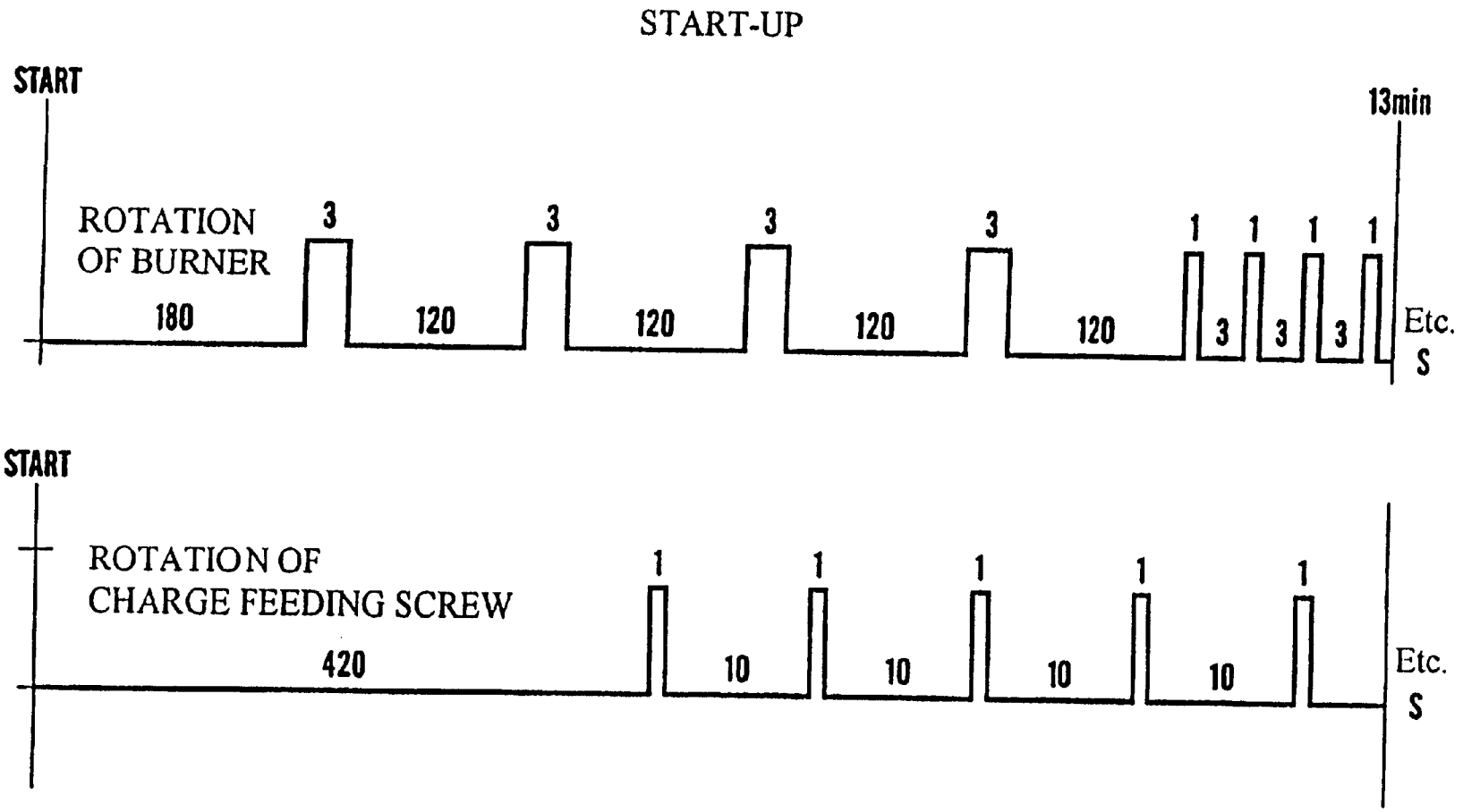
FIG. 4*a*–4*c* illustrate, in the form of graphs, a number of control programs for some of the motors which are included in the combustion apparatus.

When the automatic control is switched on, the fan motor 22 starts to rotate the fan 27 at a low speed so that a small amount of combustion air is drawn in through the intake 27A and is blown via the conduit 51 in through the openings 55 in the walls 65, 66 of the fire grate/burner. At the same time also the feeding-in screw 40 starts to rotate; to start with however with no fuel in the feeding-in tube 18 or in the down-pipe 42. The rotation programs of the burner/reactor drum 1 and of the fuel charge feeding screw 211 during the up start phase are shown in the diagrams in FIG. 4*a*. First, according to the control program, the burner has a period of rest for 180 s, whereafter it is rotated during 3 s pulses alternating with periods of rest for 120 s. During the pulses of rotation the drum is turned 13.5°/s. When this has gone on for a little more than 4 min, the program instead is switched over to rotate the burner in 1 s pulses alternating with 3 s periods of rest.

The fuel charge feeding screw 212 first is at rest for as long 7 min. During this period of time the burner thus is working with only that starting quantity of fuel that initially was placed in the burner and which after 3 min begins to be stirred through the rotation of the burner, upper diagram. When the initial 7 min have passed, the fuel charge feeding screw 212 commences to feed fuel charges intermittently during 1 s pulses alternating with 10 s periods of rest, when the fuel charge feeding screw does not move. The fuel charge feeding screw 212 takes the pellets from the transitory storage 208 which always in kept filled by means of the external screw 203 and its motor 205, which starts operating as soon as the fuel level in the transitory storage 208 has dropped below a certain level, which is registered by a level indicator 215 which is located there and which via the control unit 300 starts the external motor 205.

The charges of pellets which fall down through the down-pipe 42 fall all the way down into the feeding-in tube 18 and are successively moved forwards by the continuously rotating feeding-in screw 40. At the same time as they are moved forwards in the tube 18 by the screw 40, the pellets are also spread out, i.e. the charges that fall down through the down-pipe 42 to the screw 40 are distributed by the screw 40 so that the fuel that is delivered to the inner basket has the form of a comparatively smooth flow. The levelling out effect is magnified by the fact that the screw 40 does not have any core. In the basket 60 the pellets are preheated before the fuel leaves the drum (basket) 60 through its opening 62 so that it in the form of flow, which has been still more levelled out in the basket/drum 60, falls down on the inclined bottom/grate defined by the inner, perforated jacket 66 of the burner/drum 1.

In this way the fuel charge transportation, the feeding-in, and the rotation of the burner goes on for the period of time that has been programmed in the control unit 300. According to the example, the total duration of the start up phase is 17 minutes. If the fuel would not have start burning at this moment, a blue lamp L1 on the control panel 300 is switched on upon a signal emitted by a temperature sensor 80 in the front part of the drum 1 registering that a certain temperature has not been achieved. If that would occur, which it normally does not, one has to recommence the igniting and start up.

Normally the fuel has caught fire very well in the burner by the end of the start up period. As the start up period thus is finished in the normal mode, the system is automatically switched over to effect level E2, which is the first real "function lever", omitting effect level E1, which is a keep-alive effect level. The character of the keep-alive level E1 will be explained in the following.

Effect Level E2

Figure 4B:
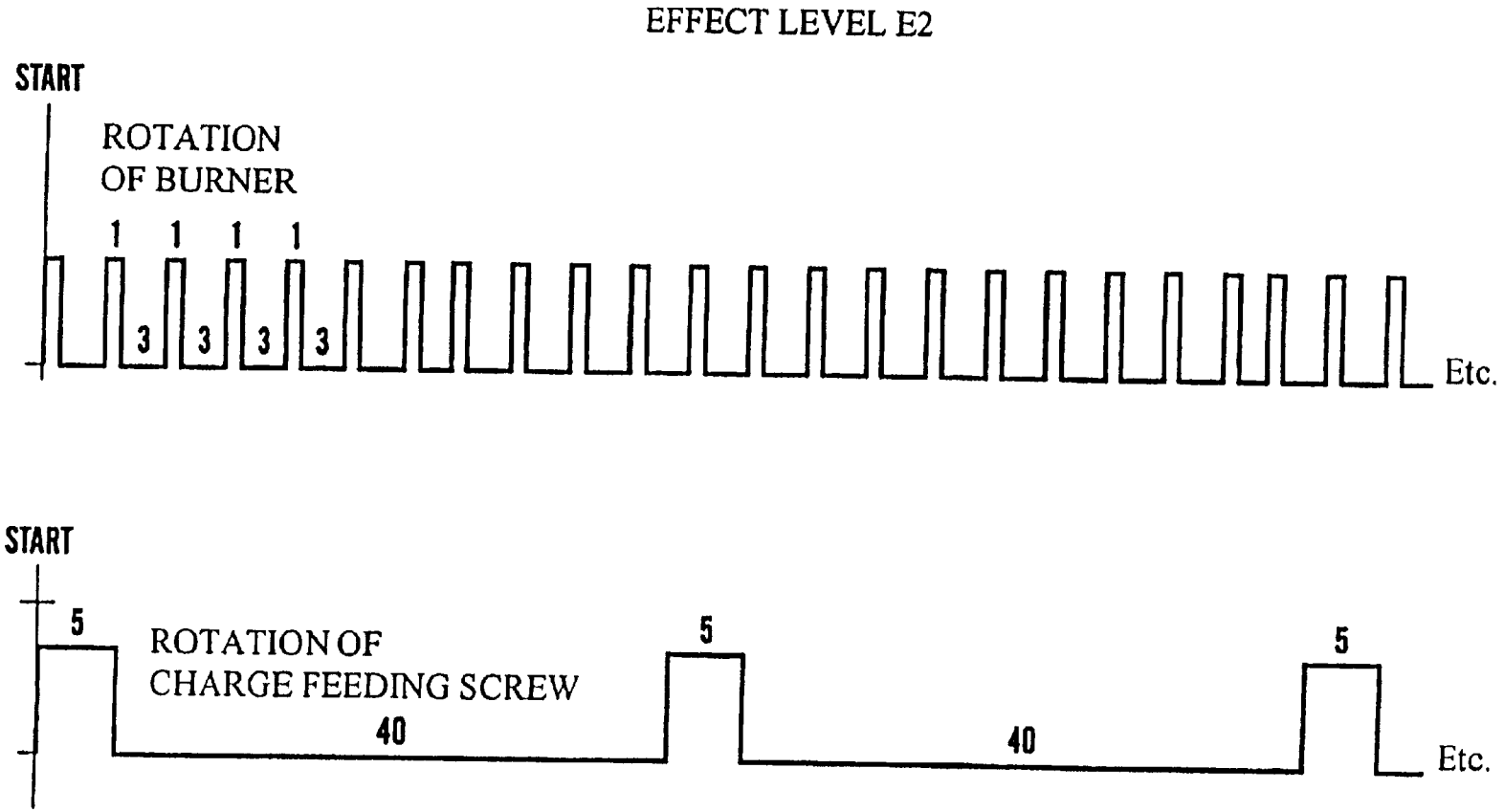

During effect level E2, FIG. 4*b*, the fan 27 and the charge feeding screw 212 are rotated at a higher rate than during the start up program, the rotational speeds of the motors 22 and 211 being so adapted to each other that the amount of combustion air that is blown in per unit of time corresponds to the charged quantity of fuel per unit of time in order to provide complete combustion. The drum/burner goes on rotating intermittently and the feeding-in screw 40 goes on rotating continuously at the same speeds as during the start up. The movement patterns of the burner and of the charge feeding screw 212 are shown in the diagram in FIG. 4*b*. Through the setting of the fuel charging and of the amount of combustion air according to the control program, the burner will generate 10 kW in effect level E2 shortly after change of effect level according to the example. This phase proceeds according to the described control program during a period of time which also is set in the control program, whereafter a shift to effect level E3 automatically is performed.

Effect Level E3–E8

At these effect levels the burner rotates continuously at a certain controlled speed. The charging of pellets by means of the fuel charge feeding screw 212 in the fuel charge unit 200 is increased and in proportion thereto also the amount of combustion air that is blown in by the fan 27 per unit of time so that the burner in each effect level will generate the intended effect. The fuel charge feeding screw 212, however, is still being rotated intermittently but with shorter and shorter breaks between the fuel charging pulses at each higher effect level. The feeding-in screw 40 at all the effect levels E3–E8 goes on rotating continuously at a constant speed in order to provide the desired even in-flow of pellets into the burner.

The effect escalating procedure is proceeds by shifting level E3 to level E4, then to level E5 etc., wherein each level has a duration which is pre-set in the program, e.g. 2 minutes. This stepwise escalation of generated effect from the burner proceeds until the pre-set temperature of the water in the hot water conduit 42 is achieved, e.g. 80° C. If this occurs e.g. at effect level E7, at which the generated effect according to the example is 85 kW, and if the desired accuracy is pre-set in the control unit 300 to be ±2° C., the following will take place if the temperature of the water in the hot water conduit 302 would rise to 82° C.: the feeding of fuel charges by means of the fuel charge feeding unit 200, as well as the rotation rate of the drum 1, is immediately shifted down to the values which apply for next lower effect level, in this case for effect level E6, while the fan 207 continuous to blow in combustion air into the combustion chamber 13 according to the program for effect level E7. The fan continuous to blow in excess combustion air until any excess fuel in the burner has been burned off, so that the remaining amount of fuel in the burner/drum will correspond with the conditions during effect level E6. This after-blow-period is programmed in the computer in the control unit 300. Thereafter the rotational rate of the fan 27 is reduced to the normal rotational rate for effect level E6. The burner now proceeds to work on effect level E6 according to the pre-set program, This goes on as long as the temperature is maintained on 80±2° C. Under normal conditions, when the changes as far as environmental temperature the consumption of hot water, etc. are concerned, are not significant, the temperature gradually will drop to 78° C. Then it is immediately, or with a certain delay in order to avoid oscillations in the system which can be difficult to control, shifted back to effect level E7. In this way the combustion apparatus can be caused to oscillate between two effect levels in a controlled mode.

Therefore, because it is possible to operate at a plurality of different effect levels, including delays between the effect levels, there will be no big jumps in the function. The system therefore can be referred to as modulating, since it all the time is adapted to the effect need in the building where the combustion apparatus is located.

Discharging of Ashes—Effect Level 1

Also the discharging of ashes is automatized in the combustion apparatus according to the preferred embodiment of the invention. Empirically knowledge has been derived that the type of pellets that is used as fuel contains a certain amount of incombustible substance which remains as ashes in an ash bin in the boiler 400. By measuring the consumption of fuel after the latest performed discharging of ashes, when the counter was reset, and by registering it in the control unit, also knowledge about how much ashes that has been produced is provided. The fuel consumption, i.e. the accumulated amount of fuel, is indicated by numerals on the display 303 on the control panel 301. This counting is made automatically in the control unit 300 according to a program which is stored in the computer. When a certain pre-set, total amount of fuel has been charged into the burner, further fuel charging is stopped and the combustion apparatus is de-escalated all the way down to effect level E1, the keep-alive level. During these de-escalation the fan continuous to blow in air until the main part of the fuel has been burned up, whereafter the discharging of ashes can be carried out.

Figure 4C:
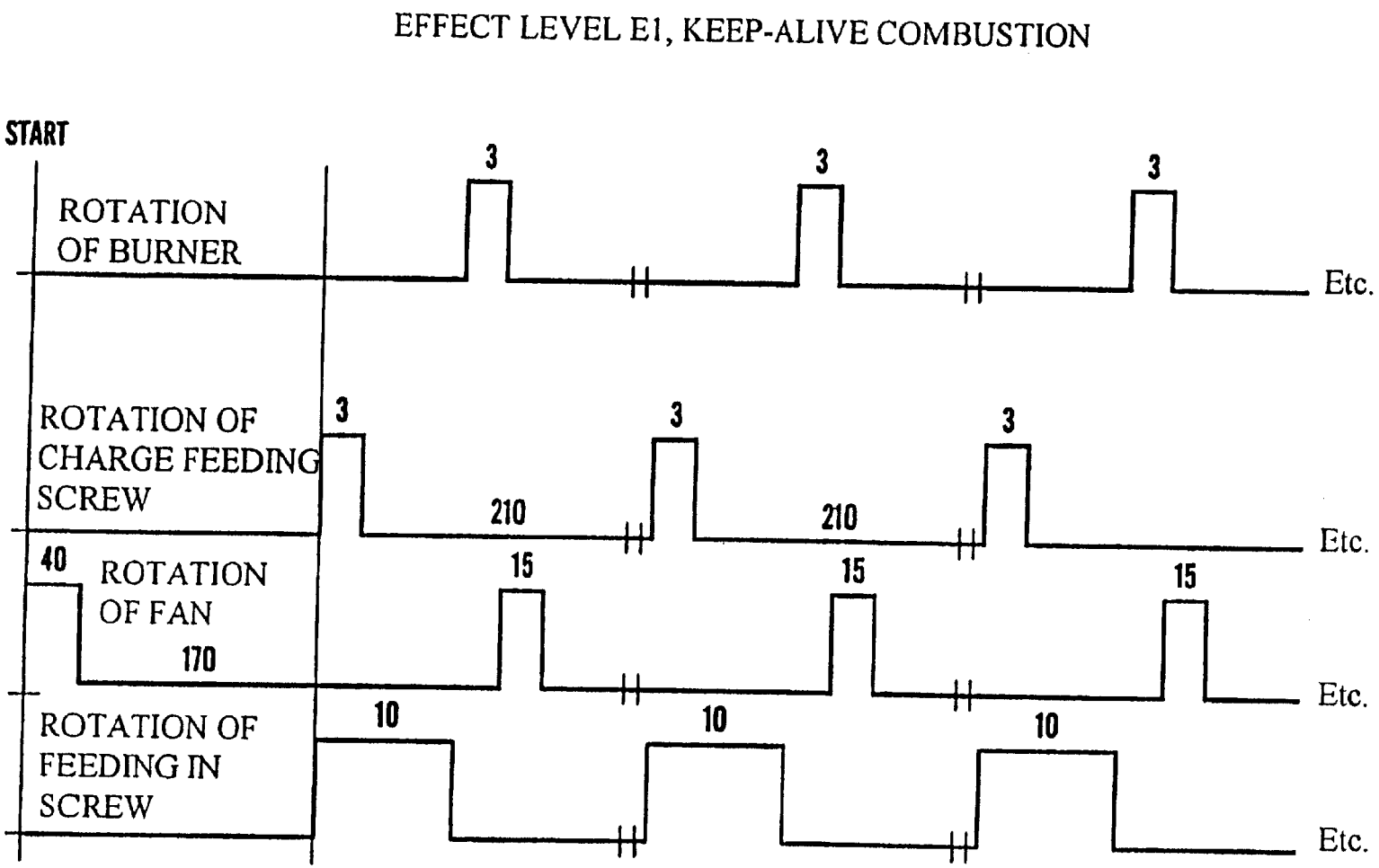

The keep-alive level, effect level E1, FIG. 4*c,* is the only effect level at which also the feeding-in screw 40 moves intermittently. The fuel charging takes place during pulses, each such pulse having a duration of 3 s, and after each such pulse the fuel charge feeding screw 212 is at complete stand still for as long as 3.5 minutes. It is therefore sufficient that the feeding-in screw moves simultaneously with the fuel charge feeding screw and than for a number of seconds, totally for 10 s, in order that all fuel shall be fed in and be distributed. Also the fan works in small blasts, 15 s, alternating with periods of rest for 198 s. The drum is turned a little for a few seconds after each feeding-in of fuel. The entire control program is designed to keep the fire alive with minimal generation of heat for a period of time that is sufficiently long for the discharging of ashes to be carried out. This also is made automatically by means of two schematically shown ashes discharging motors 90, 91, one of them working with an ash remover inside the boiler and the other one with an external ash remover. The lamps 305, 306 on the control panel 301 are switched on when the ash removers are in operation.

Description of the Control Unit 300

The central unit in the control unit 300 is the main CPU, reference numeral 308 (CPU=Computer Process Unit or microprocessor, so called PROM). The control unit 300 has the shape of a box with a control panel 301 on the front thereof The on and off button 302 and a knob 304 for pre-setting the desired hot water temperature are provided on the control panel. There is also a button 309 for switching on the motors 205 and 211 for "manual", i.e. not automatic operation of the conveyer screw 203 and of the fuel charge feeding screw 212 for feeding in fuel during the start up step. Further there is a button 310 for manual control of the two ashes discharge motors 90, 91. Moreover the control unit 300 is programmed in the control program such that the start up step will be ignored, proceeding directly with the first effect level E2 by at the same time pushing in the two buttons 309 and 310, a possibility which can be taken advantage of when the drum contains an amount of live coal sufficient for making it possible to proceed directly with effect generation after discharging of ashes.

The main CPU 308 for the effect control achieves its input information through pre-setting control parameters in the control program depending on desired effect required, type of fuel etc., said latter parameters having been pre-set in connection with the trimming; information about the hot water conduit temperature from the analogue-digital converter 405; and through information from a capacitive transmitter 218 in the transitory fuel storage 208 indicating if there is any fuel for the fuel charge feeding screw 212 to feed or not.

Figure 5:
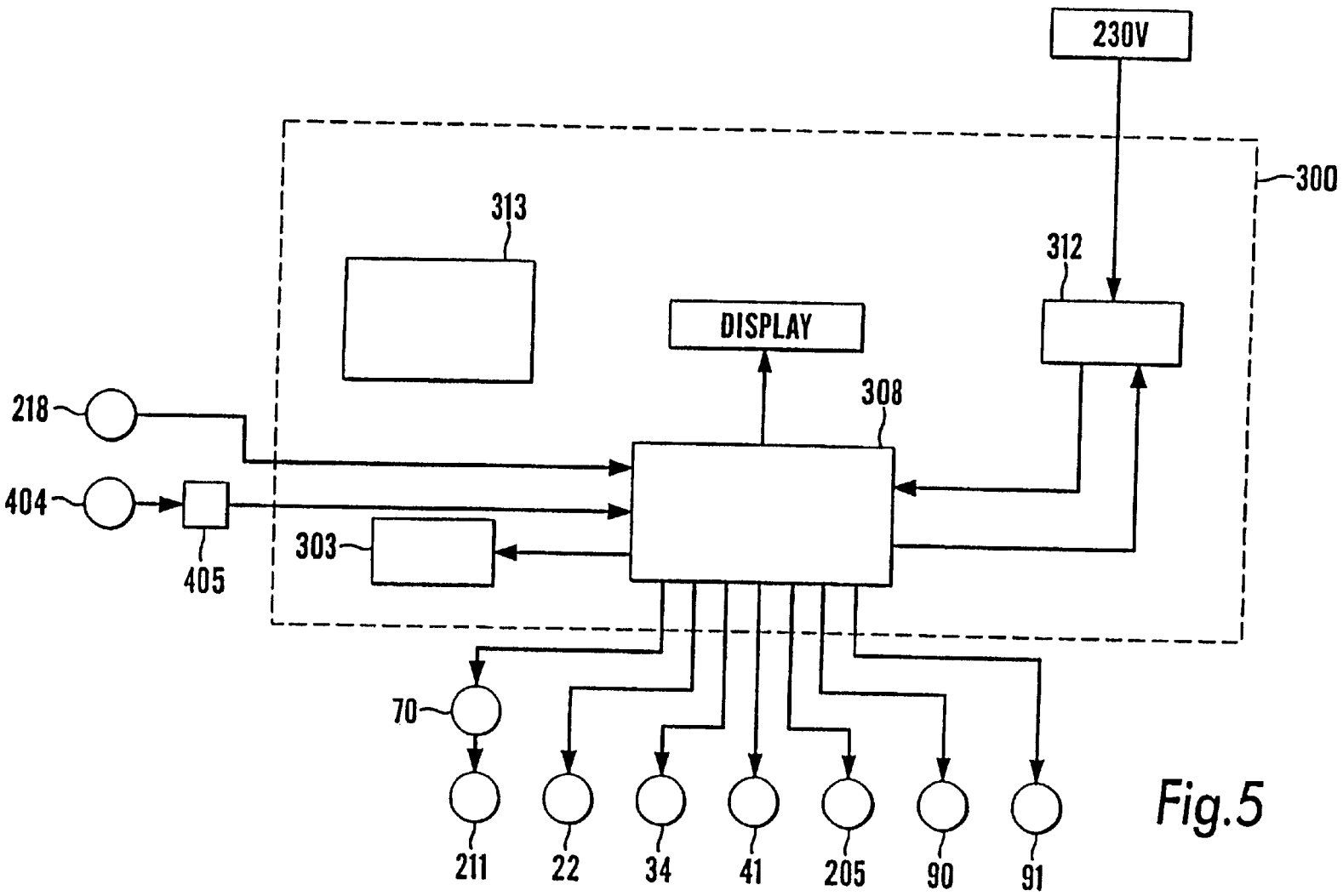
FIG. 5 is a block diagram of the effect control.

FIG. 5 also symbolically illustrates how the CPU controls the various motors which are included in the system; as far as the fuel charge feeding screw 212 is concerned via the capacitive level guard 70 in the down-pipe which is provided to stop the supply of current to the fuel charge feeding motor 211 immediately, i.e. not via the main CPU, if fuel would accumulate in the down-pipe 42.

Description of Safety and Alarm Functions

Figure 6:
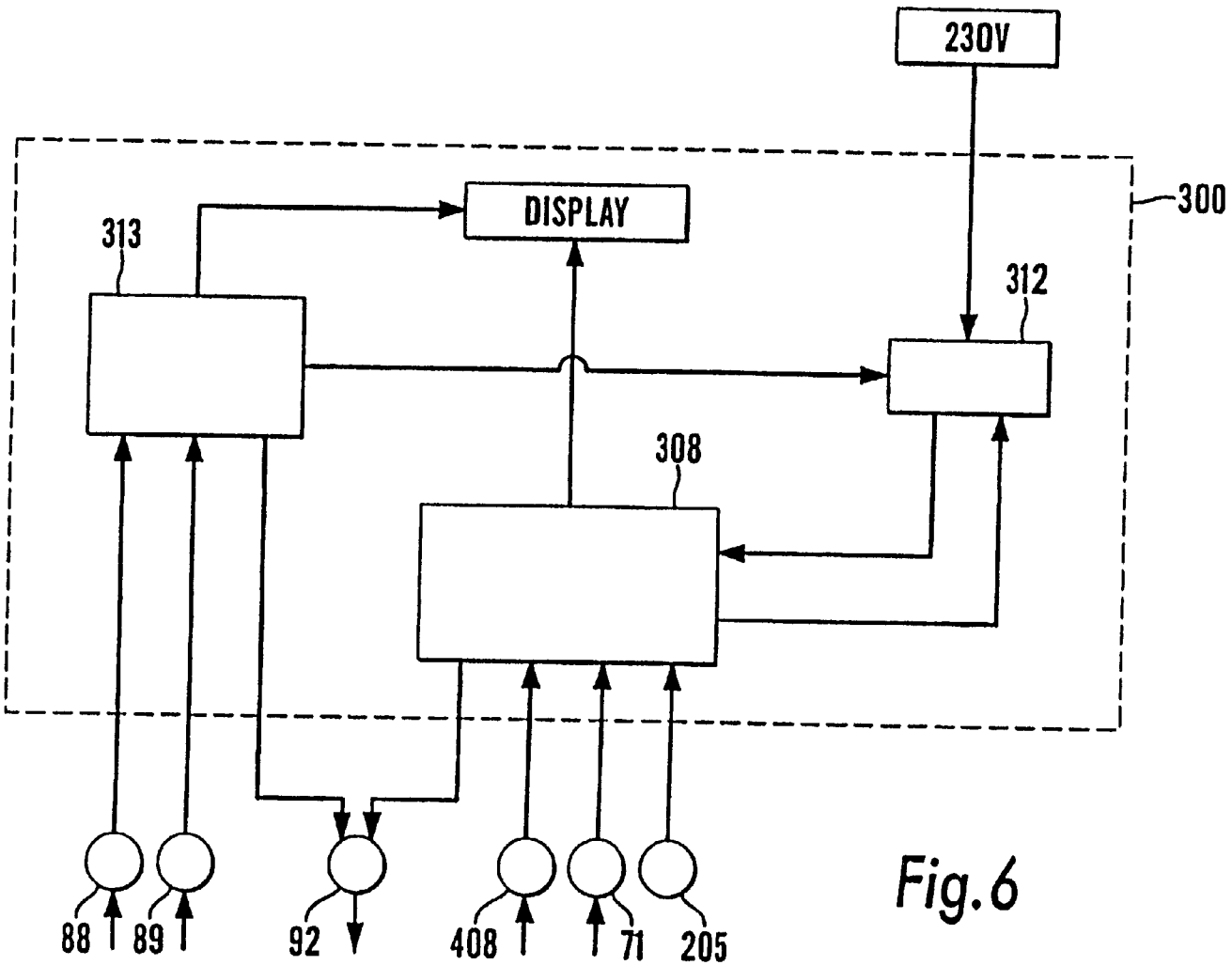
FIG. 6 is a block diagram of the safety function.

Most of the alarm and safety functions have been described in the foregoing and are also schematically illustrated in FIG. 6. A sum up of the most important functions and an elucidation will be made below.

Also the alarm and safety functions in principle are controlled by the main CPU 308 but in co-operation with the alarm CPU 313. An on and off function 312, in which the manually operatable contact 302 is included, is powered with 230 V line voltage. The electric current to the system thus can be switched off manually by means of the button 302; by command from the alarm processor 313 which is also included in the control unit 300; and by command from the main CPU 308.

On the control panel 301 there are display functions including i.a. a number of lamps L1–L6. The lamp L1 is switched on and will show a blue light, if the temperature guard 80 in the front part of the burner would not register that a pre-set temperature in the burner would be reached after start up, or if the temperature during operation would drop below a pre-set value. The lamps L2–L6 show a green light indicating that the fan motor 22, the stirring motor 34, the feeding-in motor 41, the fuel charge feeding motor 211, or the external motor 205, respectively, do operate as they are supposed to do. If they do not, a red light is shown for the motor in question on the control panel. FIG. 6 shows the different control functions which are provided to emit a signal to the alarm CPU 313. From a rotation guard 88 a signal is emitted if the drum 1 would not rotate as intended mode. From each one of the motors, which are indicated in common in FIG. 6 through reference numeral 89, alarm is emitted if any of the motors does not function. If the temperature in the boiler chimney 407 would not be at its normal high level during normal operation of the boiler, i.e. during effect generation, a temperature guard 408 in the flue duct 407 would emit an alarm signal, which however is transmitted directly to the main CPU. This is an indication that the fire from any reason has gone out, which may require a new start up. A signal is transmitted from the temperature guard 71 in the down-pipe to the main CPU 308 if the temperature in the down-pipe would rise to a pre-set level. Further a signal is emitted from the external motor 205 after a certain time period of continuous operation of the external motor, which might be an indication that e.g. the down-pipe 72 has been disconnected. Of course such a situation shall never occur but can the other hand not be neglected because of human mistakes. From the alarm CPU 313 and from the main CPU 308 signals are transmitted to the different display functions on the control panel 301 and/or to any kind of external alarm 92, which can consist of an acoustic signal and/or alarm via telephone or by other means.

In case of interruption of the electric power all motors are stopped. This i.e. implies that the burner stops rotating and that the fan stops blowing in more combustion air. The small amount of fuel existing in the burner will burn off through natural intake of air. The temperature of the water in the hot water conduit 403 in this case may rise a few degrees, which does not cause any safety risk. Even if the current interruption would have quite a long duration, so much live coal will remain in the burner that the combustion apparatus can proceed operating without new start up when the current comes back.

It is of significant importance from a safety point of view that the burner always contains a comparatively small quantity of fuel which means that any emergency cooling is not required e.g. in case of electric current interruption In the feeding-in screw there is never any large quantity of fuel. The feeding-in screw operates continuously. This means that there is always only an amount of fuel in the feeding-in pipe 18 which from a safety point of view can be neglected.

In the down-pipe 42 there is normally no fuel. From safety reason a level guard 70 is provided there. Even a burner as large as a 100 kW burner allows only 3 liters of fuel in the down-pipe. This possible quantity of fuel, in addition to the quantity of fuel existing in the feeding-in pipe 18 and in the basket 60, is the maximal quantity of fuel existing in the burner assembly 100 which at any moment does not take part in the combustion.

The rotation guard 88 is, as is mentioned above, provided to emit a signal to the control unit 300, more particularly to the alarm CPU 313, if the drum 1 would stop rotating. In this case the electric current to all the motors is switched off, which implies that the combustion in the drum would be very slow, maintained only by the natural intake of air.

The temperature guard 71 in the down-pipe 42 also is provided to stop all the motors, if the temperature would exceed a certain pre-set value.

The smoke detector 213 similarly is provided to stop all the motors via the control unit if smoke would be detected in the down-pipe section 72, e.g. because the chimney has been blocked. The temperature guard 217, on the other hand is provided directly to open the sprinkler 214 at top of the down-pipe section 72, if a certain critical temperature would be reached.

The section 72 of the down-pipe consists of a self-extinguishing plastic hose, which is burnt off if it would be overheated, breaking the connection with the units behind.

The fuel charge feeder 200 is laterally displaced to the burner's feeding-in screw. If the down-pipe would be burnt off, any fuel therefore will fall down at the side of the burner.

What is claimed is:

1. Method for automatized combustion of solid fuel in a combustion apparatus which comprises a burner with a horizontal or inclined reactor drum which is rotatable by means of a first motor (34), here called stirring motor, about the centre axis of the burner for stirring the fuel in a combustion chamber in the drum, which is connected to a boiler (400) and has a feeding-in opening (63, 62) for fuel in the rear end of the burner outside of the boiler and an outlet opening (3) for completely or partly combusted flue gases in the front end of the burner which opens in a combustion chamber (41) inside the boiler which comprises a convection unit (402), from which a hot water conduit (403) extends, said combustion apparatus also including a fan (27) provided to be driven by a second motor (22), here called fan motor, for blowing combustion air into the burner, and a fuel charge feeder (200, 212) for fuel provided to be driven by a third motor (211), here called fuel charge feeding motor, wherein the temperature of the water in the hot water conduit is measured and the measured value is transmitted to a control unit (300), characterized in that said first, second, and third motors are caused to be rotated, and the rates of said motors be regulated by command from the control unit in dependency of the measured value of the temperature of the water in the hot water conduit which is transmitted to the control unit and in dependency of the heating effect that the burner shall generate according to a number of different programs, stored in a computer in the control unit, corresponding to the same number of different effect levels, which are divided between a lowest effect level (E1) and a top effect level (E8), in order that a certain desired temperature of the water in the hot water conduit shall be achieved and be maintained, that the combustion apparatus operates according to a certain program corresponding to a certain effect generated by the burner as long as the hot water conduit temperature is maintained at the desired temperature with a certain, pre-set accuracy, i.e. within margins which are pre-set in the control unit, and that, if the pre-set maximum temperature would be exceeded or if the temperature would be lower than the pre-set minimum temperature, the control unit is shifted to a new program valid for the nearest, adjacent lower or higher effect level, respectively.

2. Method according to claim 1, characterized in that the lowest effect level (E1) is an effect level for keep-alive combustion.

3. Method according to claim 1 characterized in that when the control unit shifts to a nearest lower effect level, the fan motor (22) continuous to rotate during a certain pre-set time at the rotational rate that the fan had according to the program for the recently prevailing effect level in order to burn off any excess fuel in the burner before the rotation speed of the fan motor is shifted that rotation speed which has been programmed in the program for next lower effect level, and thereupon generate the effect which corresponds to that effect level.

4. Method according to claim 1, characterized in that the fuel charge feeder (200, 212) feeds charges of the fuel by means of the fuel charge feeding motor to a feeding-in device which is driven by a fourth motor, here called feeding-in the motor, for feeding in the charged fuel into the burner, and that the feeding-in motor rotates and drives the feeding-in device during at least those effect levels which represents at least 20% of the programmed maximum effect of the combustion apparatus.

5. Method according to claim 1, characterized in that fuel charge feeder works intermittently and delivers the fuel in the form of charges to the feeding-in device, and that the feeding-in device during operation operates in a more continuous mode than the fuel charge feeder and distributes the charged fuel so that it is fed into the burner as an evened out flow.

6. Method to claim 5, characterized in that the fuel charge feeder delivers the fuel to the feeding-in device via a down-pipe (42), and that a level guard (70) is provided to stop the operation of the fuel charge feeder if fuel would accumulate in the down-pipe to a certain, pre-set, highest limit.

7. Combustion apparatus for automatized combustion of solid fuel, comprising a burner (1) with a horizontal or inclined reactor drum (1), which is rotatable by means of first motor (34), here called stirring motor, about the center axis of the burner for stirring the fuel in a combustion chamber in the drum, which is connected to a boiler (400) and has a feeding-in opening (63, 62) for fuel in the rear end of the burner outside of the boiler and an outlet opening (3) for completely or partly combusted flue gases in the front end of the burner which opens in a combustion chamber (41) inside the boiler which comprises a convection unit (402), from which a hot water conduit (403) extends, said combustion apparatus also including a fan (27) provided to be driven by a second motor (22) here called fan motor, for blowing combustion air into the burner, and a fuel charge feeder (200, 212) for fuel provided to be driven by a third motor (211), here called fuel charge feeding motor, and a control unit (300), and a measuring device (404) for registering the temperature of the water in the hot water conduit and for transmission of the measured temperature to the control unit, characterized in that said first, second, and third motors (34, 22, 211), i.e. the stirring motor, the fan motor, and the fuel charge feeding motor, are provided to be rotated, and the rates of said motors be regulated by command from the control unit in dependency of the measured value of the temperature of the water in the hot water conduit which is transmitted to the control unit and in dependency of the heating effect that the burner shall generate according to a number of different programs. stored in a computer in the control unit corresponding to the same number of different effect levels, which are divided between a lowest effect level (E1) and a top effect level (E8), in order that a certain desired temperature of the water in the hot water conduit shall be achieved and be maintained, and that the combustion apparatus is provided to work according to a certain program in the control unit corresponding to a certain effect generated by the burner as long as the temperature of the water in the hot water conduit is maintained at the desired temperature with a certain, pre-set accuracy, i.e. within said margins pre-set in the control unit, and that, if the pre-set maximum temperature would be exceeded or if the temperature would be lower than the pre-set minimum temperature, the control unit is shifted to a new program valid for the nearest, adjacent lower or higher effect level, respectively;

wherein the lowest effect level (E1) is an effect level for keep-alive burning:

wherein when the control unit shifts to a nearest lower effect level, the fan motor (22) is provided to continue to rotate during a certain pre-set time at the rotational rate that the fan had according to the program for the recently prevailing effect level in order to burn off any excess fuel in the burner before the rotation speed of the fan motor is shifted to that rotation speed which has been programmed in the program for next lower effect level, and to thereupon generate the effect which corresponds to that effect level; and wherein the fuel charge feeder (200, 212) is provided by means of the fuel charge feeding motor to feed charges of the fuel to a feeding-in device, that a fourth motor (41), here called feeding-in motor, is provided to drive the feeding-in device for feeding the charged fuel into the burner.

8. Combustion apparatus according to claim 7, characterized in that the fuel charge feeder is provided to work intermittently and to deliver the fuel in the form of charges to the feeding device, and that the feeding device is provided during operation to work in a more continuous mode than the fuel charge feeder and to distribute the charged fuel so that the fuel is fed into the burner as an evened out flow.

9. Combustion apparatus according to claim 8, characterized in that a level guard (70) is provided in a down-pipe between the fuel charge feeder and the burner, said level guard being provided to stop the operation of the fuel charge feeder if the down-pipe would be filled with fuel up to a certain pre-set, highest limit.

* * * * *